US007719494B2

(12) United States Patent
Hu

(10) Patent No.: US 7,719,494 B2
(45) Date of Patent: May 18, 2010

(54) BRIGHTNESS ADJUSTMENT CIRCUIT AND ELECTROLUMINESCENT DISPLAY USING THE SAME

(75) Inventor: Shuo-Hsiu Hu, Tainan (TW)

(73) Assignee: Au Optronics Corporation, Hsin-Chu (TW)

( * ) Notice: Subject to any disclaimer, the term of this patent is extended or adjusted under 35 U.S.C. 154(b) by 813 days.

(21) Appl. No.: 11/550,031

(22) Filed: Oct. 17, 2006

(65) Prior Publication Data

US 2007/0242005 A1 Oct. 18, 2007

(30) Foreign Application Priority Data

Apr. 14, 2006 (TW) ..... 95113490 A

(51) Int. Cl.
*G09G 3/34* (2006.01)

(52) U.S. Cl. ..... 345/77; 345/84

(58) Field of Classification Search ..... 345/45–46, 345/76–84; 315/163.3
See application file for complete search history.

(56) References Cited

U.S. PATENT DOCUMENTS

| | | | | |
|---|---|---|---|---|
| 5,952,948 | A | 9/1999 | Proebsting | |
| 6,812,650 | B2 * | 11/2004 | Yasuda et al. | 315/169.1 |
| 6,888,526 | B2 | 5/2005 | Morita | |
| 7,123,220 | B2 | 10/2006 | Hanari et al. | |
| 7,554,513 | B2 * | 6/2009 | Sun et al. | 345/77 |
| 2007/0242005 | A1 * | 10/2007 | Hu | 345/77 |

FOREIGN PATENT DOCUMENTS

| | | |
|---|---|---|
| CN | 1648979 | 8/2005 |
| TW | 574529 | 2/2004 |
| TW | 1230913 | 4/2005 |
| TW | 200632862 | 9/2006 |
| WO | WO 2005/015530 | 2/2005 |
| WO | WO 2005/029456 | 3/2005 |

OTHER PUBLICATIONS

English language translation of abstract and pertinent parts of CN 1648979, Aug. 3, 2005.
English language translation of abstract and pertinent parts of TW 574529 (published Feb. 1, 2004).
English language translation of abstract and pertinent parts of TW 1230913 (published Apr. 11, 2005).

* cited by examiner

*Primary Examiner*—Bipin Shalwala
*Assistant Examiner*—Sosina Abebe
(74) *Attorney, Agent, or Firm*—Thomas, Kayden, Horstemeyer & Risley

(57) ABSTRACT

A brightness adjustment circuit for an electroluminescent display is provided. The brightness adjustment circuit is electrically connected to an electroluminescent panel and a power supply. The brightness adjustment circuit provides a feedback voltage to the power supply. The power supply provides a working voltage to the electroluminescent panel in response to the feedback voltage. The brightness adjustment circuit includes a circuit module and a switch or a circuit module and a voltage supply unit. The feedback voltage is modulated by operating the switch in accordance with a control signal or by a control voltage provided by a voltage supply unit.

10 Claims, 4 Drawing Sheets

BRIGHTNESS ADJUSTMENT CIRCUIT AND ELECTROLUMINESCENT DISPLAY USING THE SAME

RELATED APPLICATIONS

The present application is based on, and claims priority from, Taiwan Patent Application Serial Number 95113490, filed Apr. 14, 2006, the disclosure of which is hereby incorporated by reference herein in its entirety.

BACKGROUND OF THE INVENTION

1. Field of Invention

The invention relates to a brightness adjustment circuit, and in particular, to a brightness adjustment circuit for an electroluminescent display.

2. Related Art

In the industry of flat-panel displays, organic light-emitting diode (OLED) displays have received a lot of attention in recent years due to its self-luminescence, high brightness, super-wide viewing angle, high response speed, low working voltage, and light weight. However, the electroluminescent displays only have a limited market to date. Various display manufacturers have been trying to find an optimal manufacturing method for improving the yield product properties in order to make them more popular.

The OLED display is a self-luminescent flat-panel display. Its light source is produced by converting from a current flowing through the OLED pixels. By adjusting the current, we can determine the maximum brightness of the panel. Different gray levels are defined by the coupled thin film transistors (TFTs). The display thus achieves full colors and multiple color levels.

The working voltage ($V_{dd}$ or $V_{ss}$) of each pixel unit of the OLED is supplied by an external source. The power consumption required by all the light-emitting units in the OLED panel is provided by this single power supply system. In the circuit design, all the working voltage input terminals $V_{dd}$ of all the pixels are connected in parallel. Likewise, the terminals $V_{ss}$ are all coupled in parallel, before individually guiding them to the outermost edge of the panel and to the external power supply system via a flexible print circuit (FPC) or wires.

The external power supply is designed as a stable voltage source system. That is, it is designed to have a fixed voltage across its output terminals. This ensures that the output voltage does not vary due to an unstable input voltage or noise interference. The ordinary stable voltage source system uses a voltage feedback control means. FIG. 1 is a schematic view of a conventional feedback stable voltage power supply unit. The power supply unit 100 has a power supply 102 and a feedback circuit. The power supply 102 has a voltage output terminal $V_{out}$ and a feedback terminal 108. The voltage output terminal $V_{out}$ provides the work voltage ($V_{dd}$ or $V_{ss}$) required by the pixel units (not shown). The feedback circuit includes two resistors 104, 106 and is connected to the pixel units in parallel. One end of the resistor 104 is electrically coupled to the voltage output terminal $V_{out}$, and one end of the resistor 106 is electrically coupled to a reference voltage source. The feedback terminal 108 is electrically coupled between the resistor 104 and the resistor 106. The resistors 104, 106 have the effect of dividing the potential difference. The purpose is to produce a reference voltage (generally 1.25V) set for the system and feed it to the feedback terminal 108, monitoring the stability of the output voltage. When the reference voltage increases, the feedback terminal 108 sends out a signal to reduce the output voltage of the voltage output terminal $V_{out}$, bringing the reference voltage back to 1.25V. On the other hand, when the reference voltage decreases, the feedback terminal 108 sends out a signal to increase the output of the output voltage terminal $V_{out}$. In either case, the reference voltage is brought back to 1.25V.

However, the prior art shown in FIG. 1 only controls the stability in the brightness of the pixel units instead of adjusting the brightness. For solving problems in lifetime and residual images, some operating mode has to be provided to elongate the lifetime of the material and panel. For example, it is better not to have images with fixed positions and not to use high-brightness images for a long time. High brightness and continuous ON of the OLED are the primary reasons for shortening the panel lifetime. In view of the two consequences mentioned above, one can adopt the scheme of intermittent light-ups, e.g. 10 or 20 seconds. Afterwards, the brightness of the screen is reduced to one half or ⅓. This method can increase the panel lifetime without sacrificing its practical uses.

Therefore, a circuit that can adjust the brightness of the pixel units has been proposed in the prior art. Suppose the pixel units are required to switch among four different brightness modes, the feedback stable power supply unit has to provide a switch for four voltage outputs. A conventional method is to provide four different feedback resistor sets along with a channel switch for producing different output voltages. As shown in FIG. 2, the conventional power supply unit 200 that can adjust the brightness of the pixel units has a power supply 202 and a feedback circuit. The power supply 202 has a voltage output terminal $V_{out}$ and a feedback terminal 204. The voltage output terminal $V_{out}$ provides the working voltage ($V_{dd}$ or $V_{ss}$) required by the pixel units (not shown). In particular, $V_{dd}$ is used on the pixel units driven by P-type metal oxide semiconductor (MOS) transistors, whereas $V_{ss}$ is used on the pixel units driven by N-type MOS transistors. The feedback circuit includes four sets of serial resistors connected in parallel. Each set has two resistors in series and is connected with the pixel unit in parallel. The four sets of serial resistors include resistors 208, 210, resistors 214, 216, resistors 220, 222, and resistors 226, 228. One end of each of the resistors 208, 214, 220, 226 is electrically coupled to the voltage output terminal $V_{out}$, and one end of each of the resistors 210, 216, 222, 228 is electrically coupled to a reference voltage. The four sets of serial resistors 208 and 210, 214 and 216, 220 and 222, and 226 and 228 have connection points 212, 218, 224, and 230, respectively. The switch 206 and the feedback terminal 204 are electrically connected. The switch 206 can be electrically connected to the connection points 212, 218, 224, and 230. The four sets of serial resistors 208 and 210, 214 and 216, 220 and 222, and 226 and 228 can be designed to have different resistance values, so that the switch 206 provides different feedback voltages on the feedback terminal 204 when it is electrically connected to the connection points 212, 218, 224, and 230. The output of $V_{out}$ of the power supply 202 is adjusted to change the brightness of the pixel units. However, the conventional design of the brightness adjustment circuit occupies a substantial area in the entire circuit. Therefore, how to effectively reduce its area is an important issue in the field.

SUMMARY OF THE INVENTION

In view of the foregoing, the invention provides a brightness adjustment circuit for an OLED that can greatly reduce the area occupied by the brightness adjustment circuit by at least 50%.

In a preferred embodiment of the invention, the OLED brightness adjustment circuit includes an electroluminescent panel and a power supply unit. The power supply unit provides a working voltage to the electroluminescent panel in response to a feedback voltage. The brightness adjustment circuit at least includes: an integrated circuit module and a switch. The integrated circuit module, having a variable resistor, is electrically coupled to the electroluminescent panel and the power supply unit. The integrated circuit module includes: an internal circuit unit and an external circuit unit, wherein the internal circuit unit electrically coupled to the power supply unit and one end of the external circuit unit is electrically coupled to a common potential, such as a reference voltage unit. The switch modulates the resistance of the circuit module in response to a control signal, thereby adjusting the feedback voltage. The method of modulating the resistance of the circuit module changes the switch among different connection points to connect different parts of the external circuit with a part of the internal circuit in parallel. In another embodiment, the connection is serial. The feedback voltage is extracted from the voltage at a specific point in the circuit module. The operation of the switch changes the partial voltage at this specific point inside the circuit module, thereby changing the feedback voltage. Besides, the brightness adjustment circuit provided by the invention can be installed on an electroluminescent panel. In some embodiments, a brightness adjustment circuit for use in an electroluminescent display having an electroluminescent panel and a power supply unit, the power supply unit provides a working voltage to the electroluminescent panel in response to a feedback voltage provided from the brightness adjustment circuit. The brightness adjustment circuit comprises a circuit module electrically coupled to the power supply unit and the electroluminescent panel, and a voltage supply unit to provide a control voltage to one end of the circuit module to adjust the feedback voltage, the control voltage is variable.

In another embodiment of the invention, the electroluminescent display includes an electroluminescent panel and a power supply unit. The power supply unit provides a working voltage to the electroluminescent display in response to the feedback voltage. The brightness adjustment circuit includes at least: a circuit module, which is electrically coupled to the power supply unit and the electroluminescent panel; and a voltage supply unit, which sends a control voltage into one end of the circuit module and the feedback voltage is adjusted by the variable control voltage. The voltage supply unit can be a digital-to-analog converter (DAC) or a power, for example.

The disclosed brightness adjustment circuit does not need to modify or compute the output data of the system. It may only modify the serial or parallel connection between a part of the internal circuit and a part of the external circuit. Alternatively, a control voltage is used to achieve the enhancement or reduction of panel brightness. Besides, the invention can be used to increase the brightness of the electroluminescent display. The circuit units inside the circuit module are not limited to only two sets. There may be more than two sets of circuit units to achieve multiple-step brightness modulation.

Another aspect of the invention is to disclose an electroluminescent display using the above-mentioned brightness adjustment circuits.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

In order for the brightness adjustment circuit of an electroluminescent display to be clearly illustrated, the embodiments in this specification use a circuit module with two circuit units as an example. The invention is certainly not limited to using the circuit module with only two circuit units. The circuit modules with more than two circuit units can be used to achieve multiple-step brightness modulation as well. Moreover, P-type MOS transistors are used to drive the electroluminescent display or pixel units in these embodiments.

Embodiment 1

Figure 1:
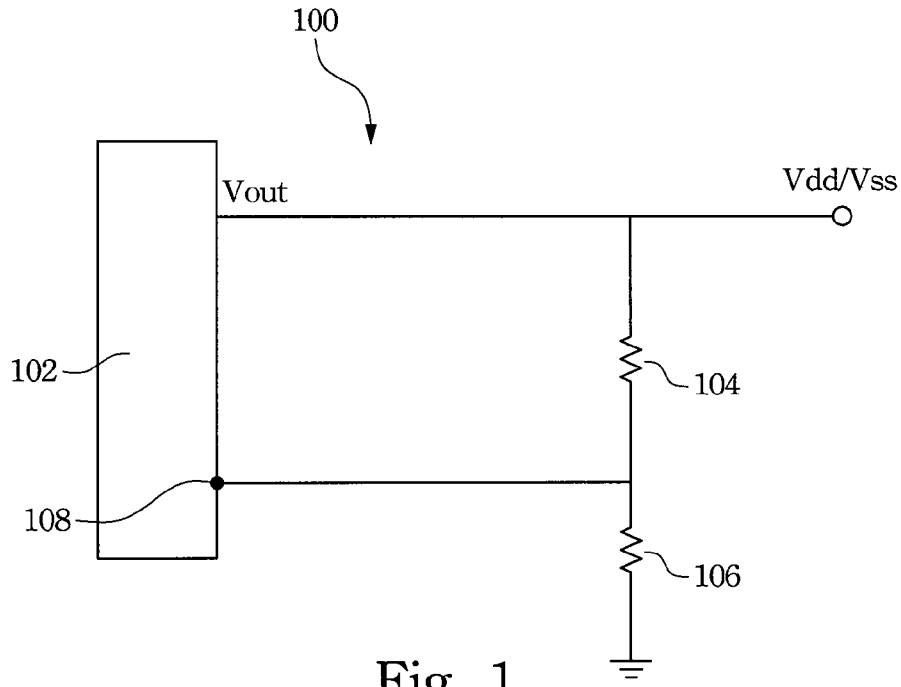
Fig. 1 (PRIOR ART)
FIG. 1 is a schematic view of the conventional feedback stable voltage power supply unit.
Figure 2:
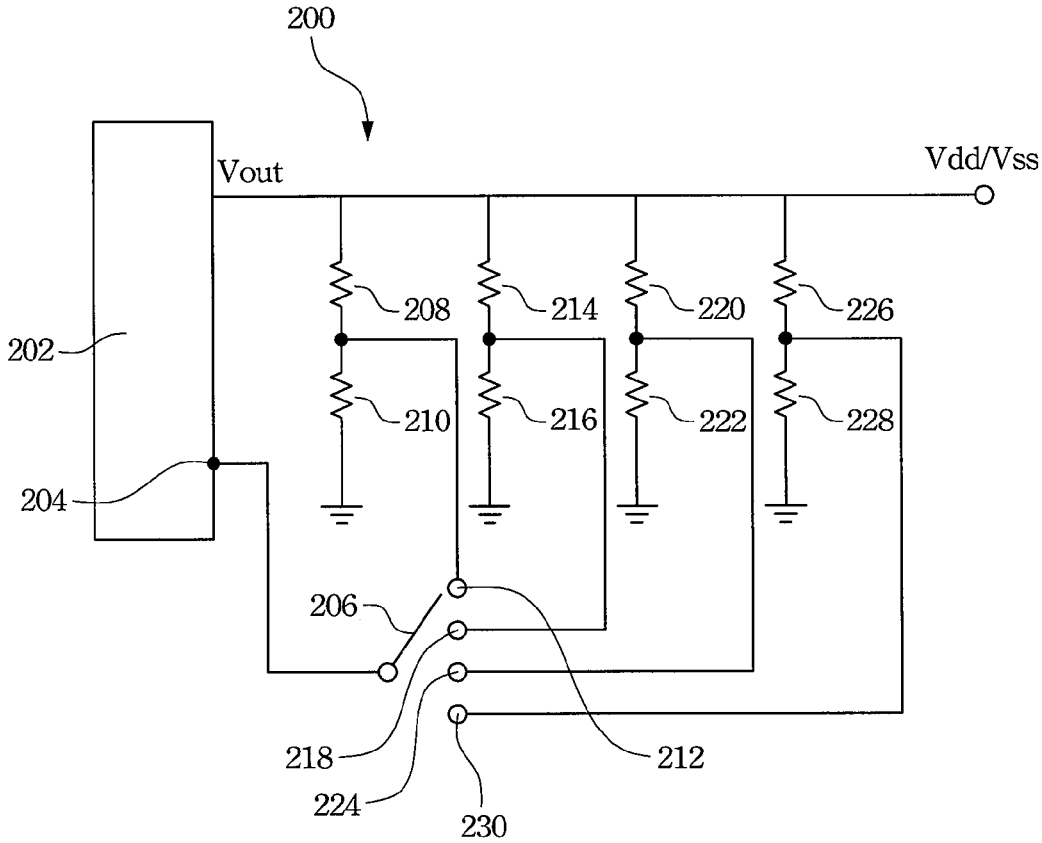
Fig. 2 (PRIOR ART)
FIG. 2 is a schematic view of the conventional feedback stable voltage power supply unit that can adjust the brightness of pixel units.
Figure 3:
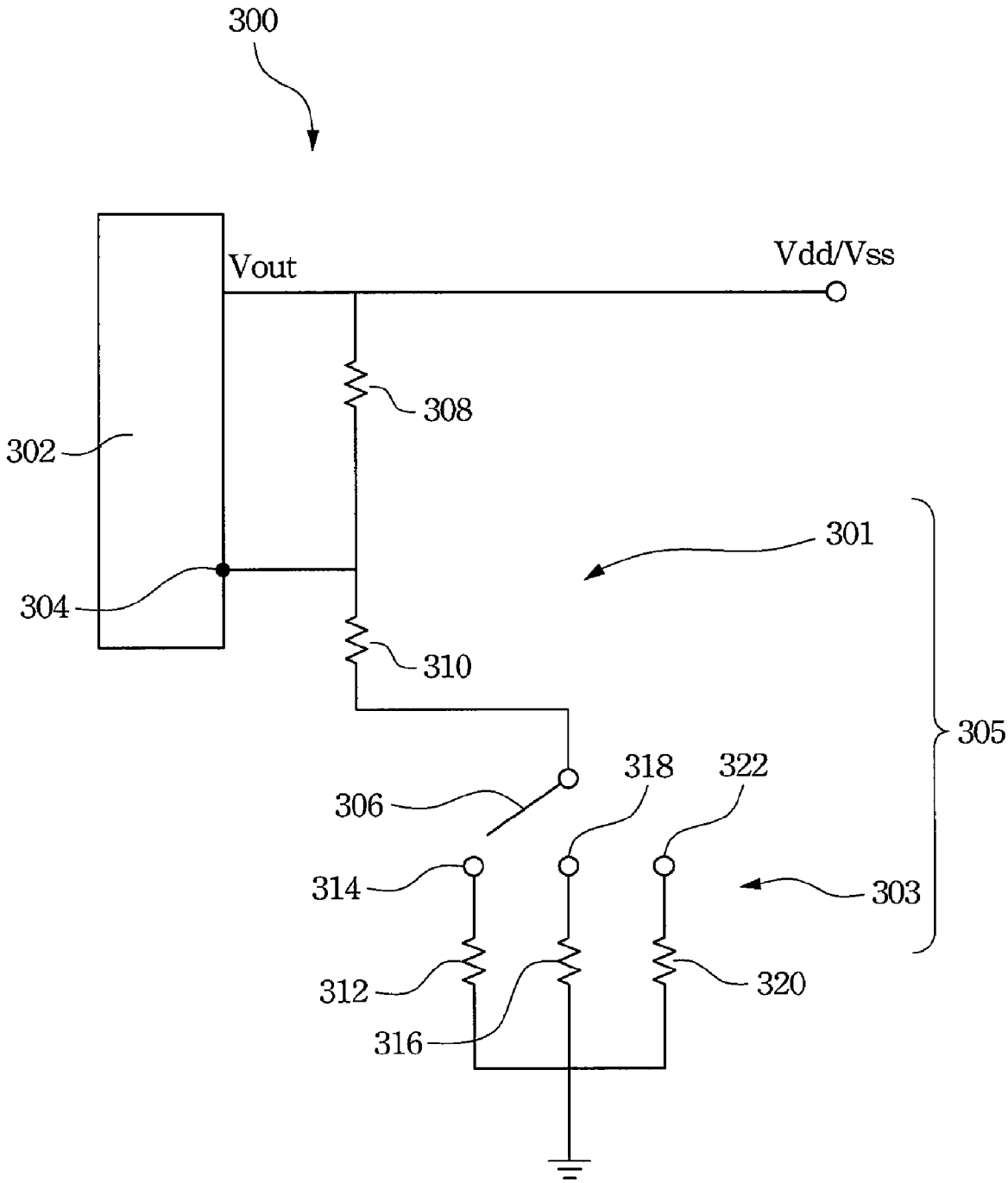
FIG. 3 shows a brightness adjustment circuit for an electroluminescent display according to a first embodiment of the invention.

With reference to FIG. 3, the power supply device 300 can provide a stable working voltage $V_{dd}$ or $V_{ss}$ to an electroluminescent display or pixel unit (not shown). The power supply device 300 has a power supply 302 with a power supply unit (not shown) and a reference voltage unit (not shown). The power supply unit and the reference voltage unit are electrically coupled. The power supply unit is coupled to the voltage output terminal $V_{out}$, and the reference voltage unit is coupled to the feedback terminal 304. This is the structure of an power supply 302 and will not be repeated below. The power supply 302 has a voltage output terminal $V_{out}$ and a feedback terminal 304. The voltage output terminal $V_{out}$ provides the working voltage $V_{dd}$ or $V_{ss}$ for the pixel unit (not shown). The feedback circuit module 305 includes an internal circuit 301, an external circuit 303, and a switch 306. The internal circuit 301 includes resistors 308 and 310, which are connected to each other and have one end electrically coupled to the voltage output terminal $V_{out}$. The feedback terminal 304 is electrically coupled to the other end of the resistor 308. The other end of the resistor 310 is electrically coupled to the switch 306. The switch 306 modulates the resistance of the circuit module 305 in response to a control signal, thereby adjusting the feedback voltage.

The external circuit 303 includes resistors 312, 316 and 320. One end of each of the resistors 312, 316 and 320 is connected to a common potential, e.g., the ground. The other end of each of the resistors 312, 316 and 320 are connected to the connection points 314, 318 and 322. The switch 306 connects the resistors 312, 316 and 320 to the internal circuit 301 in series via the connection points 314, 318 and 322, respectively. Since the resistors 312, 316 and 320 have different resistance values, the feedback voltage fed by the feedback circuit module 305 to the feedback terminal 304 varies as the switch 306 changes among the resistors 312, 316 and 320.

Take some numbers as an explicit example. Suppose the reference voltage unit of the power supply 302 provides a 0.6V reference voltage, and the resistors 308, 310, 312, 316 and 320 have the resistance values of 50 kΩ, 10 kΩ, 10 kΩ, 50 kΩ and 100 kΩ, respectively. When the switch 306 connects to the connection point 314 to connect the resistors 308, 310 and 312 in series, the output of the voltage output terminal $V_{out}$ is 2.1V. When the switch 306 connects to the connection point 318 to connect the resistors 308, 310 and 316 in series, the output of the voltage output terminal $V_{out}$ is 1.1V. When the switch 306 connects to the connection point 322 to connect the resistors 308, 310 and 320 in series, the output of the voltage output terminal $V_{out}$ is 0.87V. Therefore, the output voltage at the voltage output terminal $V_{out}$ drops from 2.1V to 0.87V. The working voltage $V_{dd}$ or $V_{ss}$ provided to the electroluminescent display or pixel unit also drops from 2.1V to 0.87V, thereby lowering its brightness. Beside, the brightness adjustment circuit can be installed on or outside the electroluminescent panel.

Embodiment 2

Figure 4:
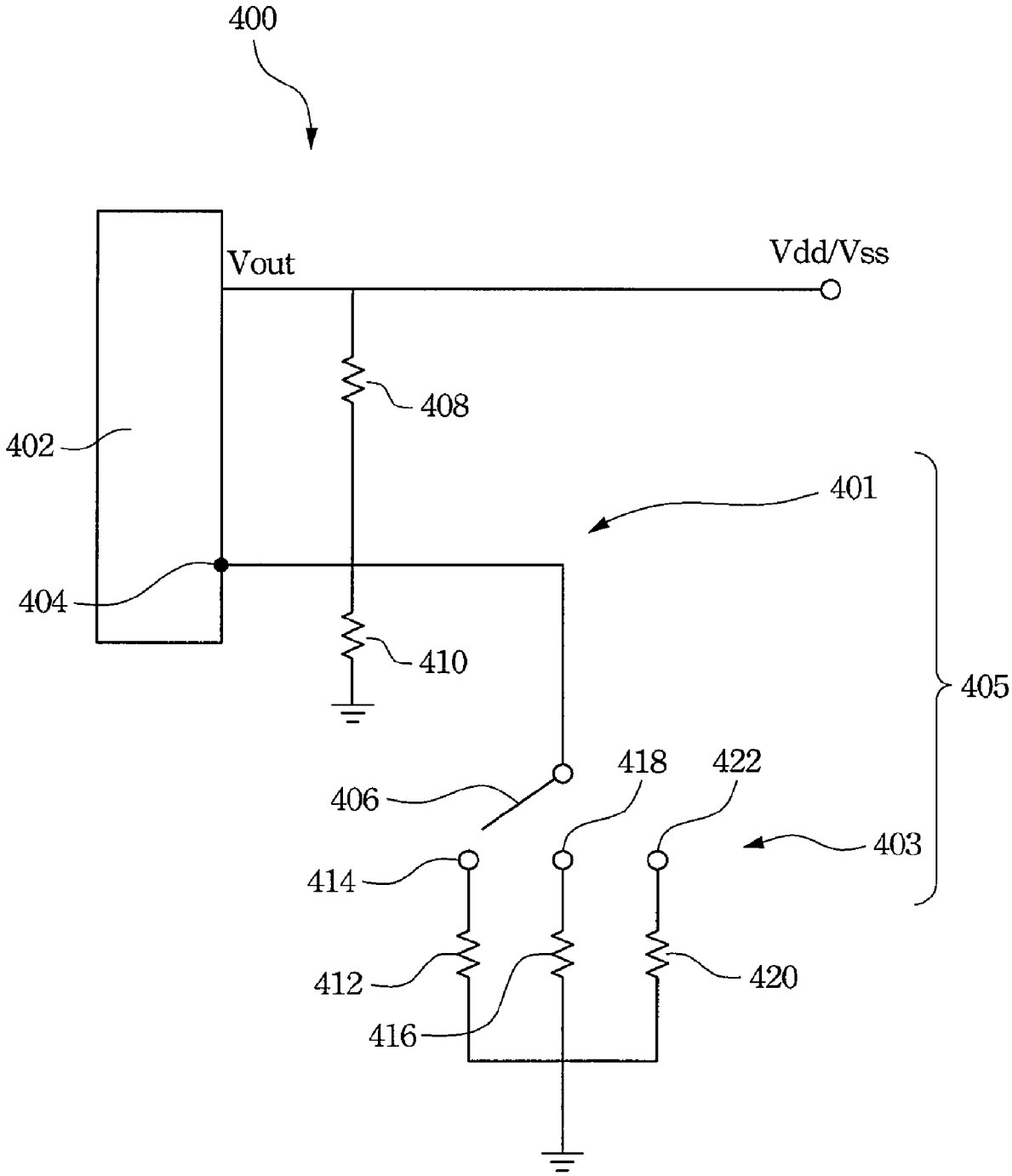
FIG. 4 shows a brightness adjustment circuit for an electroluminescent display according to a second embodiment of the invention.

With reference to FIG. 4, the power supply device 400 can provide a stable working voltage $V_{dd}$ or $V_{ss}$ to an electroluminescent display or pixel unit (not shown). The power supply device 400 has a power supply 402 with a power supply unit (not shown) and a reference voltage unit (not shown). The power supply unit and the reference voltage unit are electrically coupled. The power supply unit is coupled to the voltage output terminal $V_{out}$, and the reference voltage unit is coupled to the feedback terminal 404. This is the structure of an ordinary power supply 402 and will not be repeated below. The power supply 402 has a voltage output terminal $V_{out}$ and a feedback terminal 404. The voltage output terminal $V_{out}$ provides the working voltage $V_{dd}$ or $V_{ss}$ for the pixel unit (not shown). The feedback circuit module 405 includes an internal circuit 401, an external circuit 403, and a switch 406. The internal circuit 401 includes resistors 408 and 410, which are connected in series and have one end electrically coupled to the voltage output terminal $V_{out}$. The feedback terminal 404 is electrically coupled to the other end of the resistor 408. The other end of the resistor 410 is electrically coupled to a common potential (e.g., the ground) and the switch 406. The switch 406 modulates the resistance of the circuit module 405 in response to a control signal, thereby adjusting the feedback voltage.

The external circuit 403 includes resistors 412, 416 and 420, one end of each of which is connected to a common potential (e.g., the ground). The other end of each of resistors 412, 416 and 420 is connected to the connection points 414, 418 and 422, respectively. The switch 406 can connect to the connection points 414, 418 or 422 so as to connect the resistor 412, 416 or 420 with the resistor 410 of the internal circuit 401 in parallel. Since the resistors 412, 416 and 420 have different resistance values, the feedback voltage fed by the feedback circuit module 405 to the feedback terminal 404 varies as the switch 406 changes among the resistors 412, 416 and 420.

Take some numbers as an explicit example. Suppose the reference voltage unit of the power supply 402 provides a 0.6V reference voltage, and the resistors 408, 410, 412, 416 and 420 have the resistance values of 50 kΩ, 50 kΩ, 1000 kΩ, 50 kΩ and 40 kΩ, respectively. When the switch 406 connects to the connection point 414 to connect the resistors 410 and 412 in parallel, the output of the voltage output terminal $V_{out}$ is 1.23V. When the switch 406 connects to the connection point 418 to connect the resistors 410 and 416 in parallel, the output of the voltage output terminal $V_{out}$ is 1.8V. When the switch 406 connects to the connection point 422 to connect the resistors 410 and 420 in parallel, the output of the voltage output terminal $V_{out}$ is 1.95V. Therefore, the output voltage at the voltage output terminal $V_{out}$ increases from 1.23V to 1.95V. The working voltage $V_{dd}$ or $V_{ss}$ provided to the electroluminescent display or pixel unit also increases from 1.23V to 1.95V, thereby increasing its brightness. Beside, the brightness adjustment circuit can be installed on or outside the electroluminescent panel.

Embodiment 3

Figure 5:
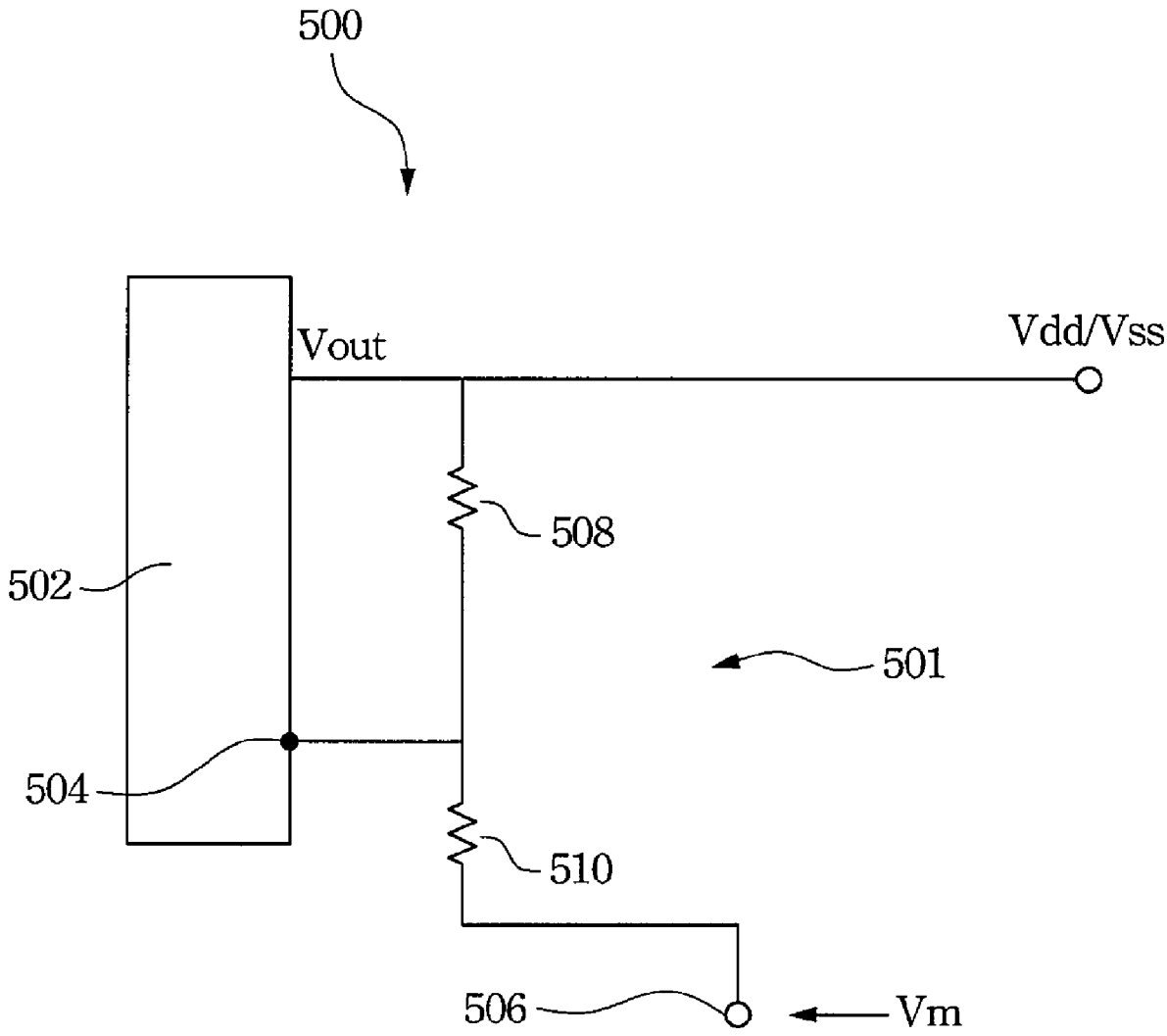
FIG. 5 shows a brightness adjustment circuit for an electroluminescent display according to a third embodiment of the invention.

With reference to FIG. 5, the power supply device 500 can provide a stable working voltage $V_{dd}$ or $V_{ss}$ to an electroluminescent display or pixel unit (not shown). The power supply device 500 has a power supply 502 with a power supply unit (not shown) and a reference voltage unit (not shown). The power supply unit and the reference voltage unit are electrically coupled. The power supply unit is coupled to the voltage output terminal $V_{out}$, and the reference voltage unit is coupled to the feedback terminal 504. This is the structure of an power supply 502 and will not be repeated below. The power supply 502 has a voltage output terminal $V_{out}$ and a feedback terminal 504. The voltage output terminal $V_{out}$ provides the working voltage $V_{dd}$ or $V_{ss}$ for the pixel unit (not shown). The feedback circuit module includes a circuit 501 and an input terminal 506. The circuit 501 includes resistors 508 and 510, which are connected to each other and have one end electrically coupled to the voltage output terminal $V_{out}$. The feedback terminal 504 is electrically coupled to the other end of the resistor 508. The other end of the resistor 510 is electrically coupled to the input terminal 506.

A voltage supply unit (not shown) automatically sends in a control voltage $V_m$ via the input terminal 506, the control voltage $V_m$ is variable. With the variation of the control voltage $V_m$, the voltage changes between the resistors 508 and 510 also occur. Therefore, the feedback voltage to the feedback terminal 504 changes accordingly.

Take some numbers as an explicit example. Suppose the reference voltage unit of the power supply 402 provides a 0.6V reference voltage, and the resistors 508 and 510 have the resistance values of 10 kΩ and 50 kΩ, respectively. When a control voltage Vm=0.1V is sent from the voltage supply unit and into the input terminal 506, the output of the voltage output terminal Vout is 3.1V. When a control voltage Vm=0.3V is sent from the voltage supply unit to the input terminal 506, the output of the voltage output terminal Vout is 2.1V. When a control voltage Vm=0.5V is sent from the voltage supply unit and into the input terminal 506, the output of the voltage output terminal Vout is 1.1V. Therefore, the output voltage at the voltage output terminal Vout drops from 3.1V to 1.1V. The working voltage Vdd or Vss provided to the electroluminescent display or pixel unit also drops from 3.1V to 1.1V, thereby reducing the brightness of the electroluminescent display. Beside, the brightness adjustment circuit can be installed on or outside the electroluminescent panel. In this embodiment, the voltage supply unit can be a DAC or a power.

The disclosed brightness adjustment circuit may not need to modify or compute the output data of the system. By changing the serial/parallel connections between a part of the internal circuit and a part of the external circuit or by inputting a control voltage, the invention can achieve the effects of increasing or reducing the brightness of the panel. Moreover, the invention can be used to increase the brightness of an OLED. The external circuit inside the circuit module is not limited to two or three sets. There can be more sets, depending upon the desired multiple-step brightness modulation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A brightness adjustment circuit for providing a feedback voltage and for use in an electroluminescent display having an electroluminescent panel and a power supply unit, the power supply unit providing a working voltage to the electroluminescent panel in response to the feedback voltage, the brightness adjustment circuit comprising:

an integrated circuit module, having a variable resistor, electrically coupled to the electroluminescent panel, including:

an internal circuit unit electrically coupled to the power supply unit; and an external circuit unit having one end applied with a common potential; and a switch for changing the resistance of the integrated circuit module in response to a control signal so as to adjust the feedback voltage, wherein the internal circuit unit includes a first resistor and a second resistor connected in series, the external circuit unit has a plurality of resistors of different resistance connected in parallel, and the second resistor and at least one of the resistors of the external circuit unit are connected via the switch.

2. The brightness adjustment circuit of claim 1, wherein one end of the second resistor is applied with the common potential, and another end of the second resistor connected to the first resistor and said at least one of the resistors of the external circuit unit are connected via the switch.

3. The brightness adjustment circuit of claim 1, wherein the second resistor and said at least one of the resistors of the external circuit unit are connected in series via the switch.

4. A brightness adjustment circuit for use in an electroluminescent display having an electroluminescent panel and a power supply unit, the power supply unit providing a working voltage to the electroluminescent panel in response to a feedback voltage provided from the brightness adjustment circuit, the brightness adjustment circuit comprising:

a circuit module electrically coupled to the power supply unit and the electroluminescent panel, wherein the circuit module comprises a first resistor and a second resistor, a first end of the first resistor is connected to the power supply unit, and a second end of the first resistor is connected to a first end of the second resistor and transmits the feedback voltage to the rower supply unit; and a voltage supply unit connected to a second end of the second resistor to provide a variable control voltage to the circuit module to adjust the feedback voltage.

5. The brightness adjustment circuit of claim 4, wherein the voltage supply unit is configured to output different voltages in response to a control signal.

6. The brightness adjustment circuit of claim 4, wherein the voltage supply unit comprises a digital-to-analog converter (DAC).

7. An electroluminescent display, comprising:

an electroluminescent panel;

a power supply unit for providing a working voltage to the electroluminescent panel; and a brightness adjustment circuit, electrically coupled to the power supply unit and the electroluminescent panel, for providing a feedback voltage to the power supply unit, the brightness adjustment circuit including:

a circuit module electrically coupled to the power supply unit and the electroluminescent panel, wherein the circuit module comprises a first resistor and a second resistor, a first end of the first resistor is connected to the power supply unit, and a second end of the first resistor is connected to a first end of the second resistor and transmits the feedback voltage to the rower supply unit; and a voltage supply unit connected to a second end of the second resistor to provide a variable control voltage to the circuit module to adjust the feedback voltage.

8. The electroluminescent display of claim 7, wherein the voltage supply unit is a DAC.

9. The electroluminescent display of claim 7, wherein the voltage supply unit outputs different voltages in response to a control signal.

10. The electroluminescent display of claim 7, wherein the display panel comprises an organic light-emitting diode (OLED) panel.

* * * * *